United States Patent [19]

Kiikka et al.

[11] 4,351,056

[45] Sep. 21, 1982

[54] CARBON ELECTRODES HAVING A LOW COEFFICIENT OF THERMAL EXPANSION

[75] Inventors: Oliver A. Kiikka, Willoughby; Donald R. Day, Garfield Heights, both of Ohio

[73] Assignee: Standard Oil Company, Cleveland, Ohio

[21] Appl. No.: 219,888

[22] Filed: Dec. 24, 1980

[51] Int. Cl.[3] ..... H05B 7/085

[52] U.S. Cl. ..... 373/88

[58] Field of Search ..... 13/18 R; 208/4, 52 R; 373/88, 90

[56] References Cited

U.S. PATENT DOCUMENTS 2,775,549 12/1956 Shea, Jr. ..... 208/52 R 3,265,093 8/1966 Wisniewski et al. ..... 208/4 X 3,350,295 10/1967 Hamner et al. ..... 208/4

*Primary Examiner*—Roy N. Envall, Jr.

*Attorney, Agent, or Firm*—William A. Heidrich; Herbert D. Knudsen; Larry W. Evans

[57] ABSTRACT

This invention is directed toward an improved carbon electrode having a coefficient of thermal expansion of less than $3.5\times10^{-7}$. Composition of the electrode includes needle coke in an amount of from about 60 to 90 weight percent and a quinoline soluble binder pitch in an amount of from about 10 to 40 weight percent, having a ring and ball softening point of from about 94° to 150° C. consisting of a highly aromatic condensation product of a distilled cycle oil extract with an extractant selected from the group consisting of furfural, phenol, B,B'-dichloro diethyl ether, nitrobenzene and sulfur dioxide.

2 Claims, 1 Drawing Figure

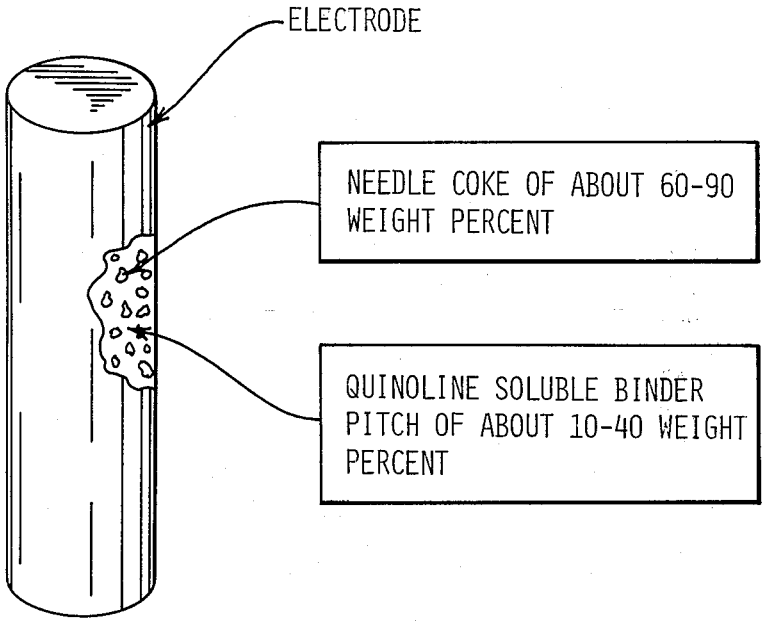
ELECTRODE
NEEDLE COKE OF ABOUT 60-90 WEIGHT PERCENT
QUINOLINE SOLUBLE BINDER PITCH OF ABOUT 10-40 WEIGHT PERCENT

CARBON ELECTRODES HAVING A LOW COEFFICIENT OF THERMAL EXPANSION

TECHNICAL FIELD

The present invention is directed toward improved carbon electrodes such as are employed in the metal manufacturing industries. The electrodes of the present invention have a very low coefficient of thermal expansion (CTE) and are therefore particularly useful for the production of steel in electric arc furnaces. Low CTE is important because of the high thermal gradients induced during the arcs and during withdrawal of the electrodes for the charging of scrap. Low CTE electrodes are utilized in ultra high power furnace and heretofore have been made from needle coke having a very low CTE that is, less than $3.5\times10^{-7}$.

BACKGROUND ART

The production of carbon electrodes is known to include the processing of coke from petroleum residues and the subsequent combination of the coke with a binder resin to provide the electrode. Coke, a solid infusible material is conventionally obtained via coking processes wherein heavy petroleum oils are heated for long periods in vessels until the coke layer builds up in the vessels. Depending upon the petroleum used as well as the processing steps and conditions employed, different types of coke are obtained. For the manufacture of carbon electrodes for use in the metal industry, several qualities of coke are recognized, the highest of which is called needle coke.

Needle coke has the lowest CTE of coke formed from petroleum hydrocarbons and is the most desirable for use in steel making. The CTE of needle coke should be less than $3.5\times10^{-7}$ to insure a low value in the resulting electrode inasmuch as existing processes have not produced electrodes with lower values than that possessed by the coke. The preparation of needle coke from petroleum is known and has been described in U.S. Pat. No. 2,775,549. In addition to disclosing several methods for producing needle coke, the patent further discloses the production of electrodes therefrom utilizing a coal tar pitch binder. Several electrodes reported in the patent according to the disclosure were measured and found to have CTE values ranging from 19 to $32\times10^{-7}$. Although these were good values for that time, by recent standards, such electrodes would only be suitable for the manufacture of aluminum, not steel.

With respect to binder pitch for these electrodes, both coal tar and petroleum pitches have heretofore been employed. A process for producing petroleum binder pitches is set forth in U.S. Pat. No. 3,355,377. The pitch is obtained in the presence of an activated carbon catalyst and is derived from the bottoms fraction after refluxing a petroleum hydrocarbon. The use of such binders in the manufacture of electrodes is stated in the patent and although the preparation of several electrodes utilizing coke aggregate having a mesh size of 4 to 200 is reported, no CTE values appear.

A U.S. patent directed toward petroleum derived resins is U.S. Pat. No. 3,265,093, owned by the assignee of interest herein. The patent discloses the impregnation of porous tubular members to help the latter survive in underground installations. Impregnation is with what is described as a petroleum derived quinoline soluble oxygenated condensation product of a distilled clarified cycle oil extract. Clarified cycle oil, in turn, refers to the material obtained as bottoms in fractionating the output of a catalytic cracking process. There is no disclosure of this impregnant being used as a binder for electrodes.

The use of coal tar and petroleum pitches as a binder for carbon electrodes has been studied by L. F. King and W. D. Robertson and is reported in an article entitled "A Comparison of Coal Tar and Petroleum Pitches as Electrode Binders," Fuel (London) 1968, 47(3), pp. 197–212. The authors basically acknowledge that coal tar pitch has been well used as a binder for petroleum coke in the preparation of carbon electrodes for aluminum manufacture. After indicating that petroleum pitches have not generally given favorable analytical data as compared to coal tar pitches, they report that petroleum thermal tars were up-graded in their work by heat soaking operations. The preparation and testing of electrodes is also discussed in their report although only density and compressive strengths are included, not CTE values. Based upon the authors' standard of electrodes that are suitable for aluminum production, those skilled in the art can appreciate that such electrodes containing petroleum pitches would not be suitable for steel manufacture where lower CTE values are a necessity.

Thus, while it is known to manufacture ultra high grade electrodes for steel making processes having low CTE values, the art of which we are aware has only appreciated that needle coke is indispensible as a component for those electrodes. Little, if anything, has been done to derive a binder material that will improve the CTE value of the resulting electrode.

DISCLOSURE OF INVENTION

It is therefore an object of the present invention to provide an improved electrode for the production of metal, particularly steel.

It is another object of the present invention to provide an improved electrode having a low CTE value, on the order of less than $3.5\times10^{-7}$.

It is yet another object of the present invention to provide an improved electrode comprising needle coke and a quinoline soluble binder resin, the latter being capable of imparting lower CTE values to the resulting electrode as when known coal tar or petroleum pitches are employed as binders.

These and other objects, together with the advantages thereof over the prior art, which shall become apparent from the specification which follows, are accomplished by our invention as hereinafter described and claimed.

The improved carbon electrode of the present invention comprises from about 60 to 90 weight percent of needle coke and from about 10 to 40 weight percent of a quinoline soluble binder pitch prior to baking and graphitizing. The preferred amount is about 26 weight percent and the binder pitches that can be employed are those having a ring and ball softening point of from about 94° to 150° C. consisting of highly aromatic condensation products of a distilled cycle oil extract with an extractant selected from the group consisting of furfural, phenol, B,B'-dichloro diethyl ether, nitrobenzene and sulfur dioxide. The coefficient of thermal expansion of the electrode is less than $3.5\times10^{-7}$.

BRIEF DESCRIPTION OF THE DRAWING

The drawing FIGURE represents a perspective view of a carbon electrode with a portion partially broken away depicting schematically the needle coke particles and the quinoline soluble binder pitch which comprise the carbon electrode of the present invention as hereinafter described. The needle coke particles and the quinoline soluble binder pitch are labeled and include their respective weight percent range for the practice of the invention.

PREFERRED MODE FOR CARRYING OUT THE INVENTION

A primary object of the present invention being to provide a carbon electrode having a low CTE value, the electrode must comprise needle coke as a component. For purposes of discussion herein, low CTE refers to a value of less than $3.5\times10^{-7}$. Furthermore, the CTE values hereinafter provided shall imply the $10^{-7}$ factor.

Needle coke suitable for practice of the present invention is described in the aforementioned U.S. Pat. No. 2,775,549, the subject matter of which is incorporated herein by reference. The coke particles generally have a needle-like appearance and high metallic luster when crushed. A suitable commercial source of needle coke is Mocar Coke from Mountaineer Carbon Co. Physical properties thereof include: resistivity 0.037; real density 2.11; ash 0.18 weight percent; sulfur 1.38 weight percent; silicon 0.014 weight percent; and ABD 81.

A suitable binder pitch for the electrode of the present invention is the impregnant described in the aforementioned U.S. Pat. No. 3,265,093. As stated in the patent, the materials, i.e., the impregnants, comprise uncoked solvent extracted oxygenated condensation products of a distilled clarified cycle oil. Inasmuch as submission to coking temperatures increases carbonaceous insolubles or quinoline insolubles, which adversely affect impregnation, such temperatures are avoided. Solvent extraction effects a concentration of aromatics which are desirable in the ultimate production of a highly kerosene resistant product. Solvent extraction removes non-resinous and non-condensible constituents. Distillation further concentrates the aromatics, removes non-resinous constituents and confers an increased flash point on the final product. Oxygenation of the molten material effects a condensation of aromatics effectively increasing the molecular weight of the material. The resultant product is quinoline soluble and virtually insoluble in petroleum ether (B.P. 30° C.). Flash point after distillation is a minimum of 254° C. Oxygenation of the molten material to derive the product is not mandatory, so long as the product employed is totally quinoline soluble and has the proper melting point and molecular weight which, in turn, can be obtained by heat soaking, distillation or solvent extraction to remove the quinoline insoluble material.

The petroleum-derived material is thus a distilled highly aromatic quinoline soluble fraction of petroleum oil boiling above about 316° C. and the initial boiling point being preferably within the range of 371° to 427° C., or approximately 399° C., which has been oxygenated, as by air blowing, to a ring and ball softening point within the range of 66° to 121° C. and preferably 77° to 82° C. A particularly suitable highly aromatic fraction is the heavy end, i.e., the second 50 volume percent of extracted clarified cycle oil. Clarified cycle oil, also known as decanted cycle oil, is used to describe the material obtained as bottoms in fractionating the output of a catalytic cracking process.

After the initial breakup of crude oil into raw products by simple distillation, the fraction having a boiling range of from about 260° to 316° C. up to about 538° to 593° C. is subjected to a catalytic cracking procedure. The output of the cracker is then fractionated into an overhead stream, one or more side streams and bottoms. Regardless of the catalyst handling system used in the cracker, appreciable quantities of powdered catalyst are carried over from the cracking unit to the fractionator and settle in the aforementioned bottoms. The bottoms are separated from the catalyst by any known clarification procedure, and recycled back to the cracking unit and subjected to further cracking. From these manipulative steps come the terms cycle oil and clarified cycle oil.

The extractive treatment of clarified cycle oil separates primarily the aromatics (extract) from the paraffins (raffinate), the former of which is utilized. Solvents such as furfural, phenol, B,B'-dichloro diethyl ether, nitrobenzene, Duosol (propane and cresol) and sulfur dioxide preferentially solubilize aromatics and naphthenes and may be used in the extractive treatment of clarified cycle oil. Of these, furfural is preferred as a means for concentrating the aromatic content of the extract, i.e. to remove aliphatic and cycloaliphatic constituents.

Clarified cycle oil extract as defined above is a complex mixture of highly aromatic hydrocarbons and as such does not admit of absolute chemical analysis. The composition of the extract will vary as functions of the crude oil from which it is derived and the conditions of initial distillation, cracking, fractionating, etc. A typical sample of clarified cycle oil extract, analyzed according to the Shell n-d-m procedures ("Aspects of the Constitution of Mineral Oils," K. Van Nes et al., Elsevier Publishing Co., Inc., 1951, pp. 318-346), has been reported in Table I.

TABLE I

| Sample | 0-10% | 10-20% | 20-30% | 30-40% | 40-50% | 50-60% | 60-70% | 70-80% | Btms. |
|---|---|---|---|---|---|---|---|---|---|
| Grav., API | 11.3 | 5.8 | 3.9 | 2.4 | 0.5 | −1.9 | −4.5 | −5.9 | −14.4 |
| $d_4^{70°\,C}$ g/cc | 0.9574 | 0.9972 | 1.0122 | 1.0239 | 1.042 | 1.0591 | 1.0825 | — | — |
| Pour Point. °C. | −4 | +7 | +13 | +18 | +21 | +21 | +16 | +21 | — |
| Flash Point, °C. | 168 | 182 | 204 | 196 | 232 | 243 | 252 | 254 | — |
| Color D-155 | 2− | blue | green | 2 | 2 | 2.5 | 4 | 4 | — |
| Vis. at 99° C. SSU | 32.2 | 35.3 | 36.5 | 30.61 | 44.98 | 53.7 | 77.9 | 107.6 | — |
| Vis. at 38° C. SSU | 48.6 | 80.8 | 105.1 | — | — | — | — | — | — |
| Vis. Grav, Constant | 0.996 | 1.047 | 1.065 | 1.06 | 1.075 | 1.090 | 1.109 | — | — |
| $n_D^{70°\,C.}$ | 1.5587 | 1.5906 | 1.6021 | 1.6141 | 1.6316 | 1.6495 | 1.6690 | — | — |
| Aniline Point °C. | 19 | 21 | 24 | 29 | 32 | 35 | 33 | — | — |
| Total Sulphur, wt. Percent | 1.43 | 2.03 | 2.21 | 1.91 | 1.65 | 1.63 | 1.83 | 1.76 | 1.08 |
| Total Nitrogen, wt. Percent | 0.025 | 0.05 | 0.062 | 0.067 | 0.054 | 0.047 | 0.062 | 0.063 | 0.055 |
| Percent Carbon as Rings | 67.1 | 66.8 | 66.9 | 63.3 | 61.1 | 58.4 | 57.6 | — | — |
| Percent Carbon as | | | | | | | | | |

TABLE I-continued

| Sample | 0-10% | 10-20% | 20-30% | 30-40% | 40-50% | 50-60% | 60-70% | 70-80% | Btms. |
|---|---|---|---|---|---|---|---|---|---|
| Paraffins | 32.9 | 33.2 | 33.1 | 36.7 | 38.9 | 41.6 | 42.4 | — | — |
| Percent Carbon as Aromatic | 61.3 | 66.8 | 66.9 | 63.3 | 61.1 | 58.4 | 57.6 | — | — |
| Percent Carbon as Naphthenes | 5.8 | 0.0 | 0.0 | 0.0 | 0.0 | 0.0 | 0.0 | — | — |
| Total Rings per Molecule | 1.94 | 1.97 | 2.05 | 2.09 | 2.1 | 2.04 | 2.07 | — | — |
| Rings/Mol. as Aromatics | 1.65 | 1.97 | 2.04 | 2.09 | 2.1 | 2.04 | 2.07 | — | — |
| Rings/Mol. as Naphthenes | 0.29 | 0.0 | 0.0 | 0.0 | 0.0 | 0.0 | 0.0 | — | — |
| Carbon Atoms/Molecule | 15.8 | 17.1 | 17.4 | 17.5 | 19.4 | 19.0 | 20.7 | — | — |
| Molecular Weight | 210 | 220 | 225 | 240 | 250 | 256 | 265 | 270 | — |

Typical characteristics for the heavy ends of clarified cycle oil extract are presented in Table II. These properties are for the heavy ends, e.g., the 40 to 100 volume percent fraction obtained by distillation to remove the light ends.

TABLE II

| | |
|---|---|
| Gravity API | −8.6 |
| Sp. gr. at 15.6° C. | 1.1512 |
| Vis. SSF at 121° C. | 19.7 |
| Flash point, °C. | 274 |
| Ramsbottom carbon residue, wt. percent | 14.71 |
| Wt. percent sulfur | 1.23 |
| Penetration at 25° C. | 90 |
| Ring and ball softening point, °C. | 39.4 |
| ASTM distillation, °C.—vol. percent distilled, °C. | |
| IBP | 397 |
| 2% | 409 |
| 5% | 418 |
| 10% | 427 |
| 20% | 440 |
| 30% | 449 |
| 40% | 460 |
| 50% | 475 |
| 60% | 487 |
| 70% | 505 |
| 80% | — |
| 100% | — |

As noted above, the heavy ends of clarified cycle oil extract, or distilled clarified cycle oil extract, are oxygenated, for example by blowing with an oxygen-containing gas, such as air, to a ring and ball softening point within the range of 66° to 121° C. and preferably 77° to 82° C. This product unlike other petroleum resins is characterized by the absence of carbonaceous insolubles. A convenient and reliable test for carbonaceous insolubles is the solubility of the impregnant in quinoline. Oxygenated condensation products of distilled clarified cycle oil extract in accordance herewith show no more than a trace of quinoline insolubles, and are preferably 100% soluble in quinoline. More generally, any highly aromatic quinoline soluble fraction within this range of melting points can be employed whether it has been derived from petroleum or coal tar so long as quinoline insolubles are suitably removed as discussed hereinabove.

The material described in U.S. Pat. No. 3,265,093 is commercially available under the registered trademark Trolumen, owned by the assignee of record herein. The product is usually designated by a number following the name which corresponds to the ring and ball softening point thereof in degrees Fahrenheit. Thus, Trolumen 230, utilized in the examples reported herein, has a softening point of 230° F. (115° C.). Generally, materials having a softening point of between about 200° to 300° F. (94° to 150° C.) are suitable with 240° F. (118° C.) being preferable.

Manufacture of the electrode is via a conventional process which includes the steps of mixing the needle coke, having been calcined at about 1400° C., with the binder; extruding the mixture to form a green electrode; baking the green electrode at about 790° C.; and thereafter subjecting the electrode to treatment in a graphitizing furnace at 2760° C.

The amount of each component employed is preferably in the ratio of about 74 parts of needle coke to about 26 parts of binder, on a weight basis. In order to provide homogeniety, a small quantity of oleic acid is also added to the mixture. More broadly, the amount of needle coke added to the mixture is from about 60 to 90 weight percent; the amount of binder is from about 10 to 40 weight percent, and the amount of oleic acid is on the basis of about 1 g per 100 g of coke-binder mixture. During the baking and graphitizing steps of the process approximately 40 to 60 percent of the binder content is removed.

The drawing FIGURE depicts the electrode of the present invention and identifies the weight percentage range of the needle coke and quinoline soluble binder pitch. The needle coke appears schematically in a broken away section of the drawing to indicate that the electrode is a composite of the coke and binder pitch resin.

As stated hereinabove, we have discovered that the use of a binder pitch having the properties of Trolumen as a component of a carbon electrode will provide an electrode having a low CTE. While the use of needle coke is required, the quality thereof need not be the highest grade because the binder pitch will upgrade the coke, producing a lower CTE value for the electrode than was possessed by the needle coke. This is clearly contrary to what has normally been experienced in the art. Generally, the electrodes comprise coal tar pitch, which raises the CTE value initially possessed by the needle coke. Therefore, the use of a petroleum pitch which actually improves, or at least maintains, the CTE value of the needle coke has not heretofore been disclosed.

In the work reported hereinbelow, several electrodes were prepared utilizing different grades of needle coke, a typical coal tar pitch and Trolumen 230 as the binder pitch. The composition of the electrode included 500 g of needle coke, 175 g of binder pitch and 8 ml of oleic acid. Two to four electrodes of each formulation were extruded and their CTE values were measured. Original average CTE of the needle coke has also been reported and is based upon data from an independent laboratory.

Table IV is divided into three series each of which includes one type of needle coke and either Trolumen 230 binder pitch or coal tar binder pitch, the latter comprising coal tar pitch Grade 30 M (Medium), being available from Allied Chemical Co., Morristown, N.Y.

The coal tar pitch does not comprise the quinoline soluble material of the present invention and has been selected as a state of the art binder pitch for comparison with Trolumen. Extrusion conditions for each of the series appear in Table III.

TABLE III

| | Extrusion of Carbon Electrodes | | |
|---|---|---|---|
| | Barrel Temp. °C. | Die Temp. °C. | Extrusion Rate cm/min. |
| Series I | | | |
| Trolumen | 121° | 88° | 13.0 |
| Coal Tar | 128° | 96° | 14.5 |
| Series II | | | |
| Trolumen | 126° | 93° | 11.9 |
| Coal Tar | 128° | 95° | 15.2 |
| Series III | | | |
| Trolumen | 128° | 96° | 12.2 |
| Coal Tar | 127° | 98° | 12.7 |

TABLE IV

| | Comparison of Trolumen 230 and Coal Tar Pitch as Binder Pitch | | | |
|---|---|---|---|---|
| Pitch | Electrode | Green Density g/cc | Graphitized Density g/cc | CTE at 100° C. |
| | Series I Needle Coke - Mocar E1364 Avg. CTE (100° C.) 3.8 | | | |
| Trolumen | | | | |
| | 1 | 1.720 | 1.323 | 2.7 |
| | 2 | 1.723 | — | — |
| | 3 | 1.721 | 1.313 | 2.3 |
| | 4 | 1.723 | — | — |
| | Avg. | 1.722 | 1.318 | 2.5 |
| Coal Tar | | | | |
| | 5 | 1.768 | 1.529 | 4.93 |
| | 6 | 1.768 | 1.525 | 4.64 |
| | 7 | 1.768 | 1.528 | 4.61 |
| | 8 | 1.768 | 1.535 | 4.81 |
| | Avg. | 1.768 | 1.529 | 4.75 |
| | Series II Needle Coke - Mocar E1455 Avg. CTE (100° C.) 4.4 | | | |
| Trolumen | | | | |
| | 9 | 1.723 | 1.325 | 2.5 |
| | 10 | 1.727 | — | — |
| | 11 | 1.727 | 1.319 | 3.0 |
| | Avg. | 1.726 | 1.319 | 2.75 |
| Coal Tar | | | | |
| | 12 | 1.760 | 1.500 | 5.5 |
| | 13 | 1.760 | 1.504 | 4.7 |
| | 14 | 1.759 | 1.500 | 5.5 |
| | 15 | 1.760 | 1.474 | 4.3 |
| | Avg. | 1.760 | 1.494 | 5.0 |
| | Series III Needle Coke - Mocar E2485 Avg. CTE (100° C.) 2.6 | | | |
| Trolumen | | | | |
| | 16 | 1.718 | 1.309 | 1.4 |
| | 17 | 1.718 | — | — |
| | 18 | 1.719 | 1.311 | 1.5 |
| | Avg. | 1.718 | 1.310 | 1.45 |
| Coal Tar | | | | |
| | 19 | 1.762 | 1.511 | 2.4 |

TABLE IV-continued

| | Comparison of Trolumen 230 and Coal Tar Pitch as Binder Pitch | | | |
|---|---|---|---|---|
| Pitch | Electrode | Green Density g/cc | Graphitized Density g/cc | CTE at 100° C. |
| | 20 | 1.762 | 1.505 | 2.5 |
| | 21 | 1.764 | 1.522 | 2.8 |
| | Avg. | 1.763 | 1.513 | 2.57 |

Series I indicates that electrodes made with a slightly low grade needle coke have improved CTE values when Trolumen is employed as the binder resin. Coal tar pitch further raises CTE. Series II indicates that electrodes made with a poor grade needle coke have improved CTE values sufficient to make them acceptable for steel production, whereas coal tar pitch again results in an unacceptable electrode. Lastly, Series III indicates that high grade needle coke is still further improved when Trolumen is employed as the binder resin. Use of coal tar pitch with this grade of needle coke somewhat raises the CTE value although the electrode is still acceptable, being below 3.5.

Based upon the foregoing results, it can be seen that the use of a quinoline soluble binder pitch such as Trolumen carries out the objects set forth hereinabove. It is to be understood that the electrodes disclosed herein can include other components such as oleic acid.

It should also be apparent to those skilled in the art that electrodes of the subject invention can comprise varying ratios of needle coke and binder pitch resins as well as binder pitch resins comparable to Trolumen so long as they would be a quinoline soluble resin having a comparable melting point. It is to be understood that such variations fall within the scope of the claimed invention and that the subject invention is not to be limited by the examples set forth herein. These have been provided merely to demonstrate operability and therefore the selection of specific grades of needle coke and of a particular binder pitch resin can be determined without departing from the spirit of the invention herein disclosed and described. Moreover, the scope of the invention shall include all modifications and variations that may fall within the scope of the attached claims.

We claim:

1. An improved carbon electrode having a coefficient of thermal expansion less than $3.5\times10^{-7}$ comprising:

needle coke in an amount of from about 60 to 90 weight percent and having a coefficient of thermal expansion of up to about $8\times10^{-7}$; and a quinoline soluble binder pitch in an amount of from about 10 to 40 weight percent, prior to baking and graphitization, said binder pitch having a ring and ball softening point of from about 94° to 150° C. consisting of a highly aromatic condensation product of a distilled cycle oil extract with an extractant selected from the group consisting of furfural, phenol, B,B'-dichloro diethyl ether, nitrobenzene and sulfur dioxide.

2. An improved carbon electrode, as set forth in claim 1, wherein the amount of needle coke is 74 weight percent and the amount of said binder pitch is 26 weight percent prior to baking and graphitization.

* * * * *